United States Patent [19]

Sato

[11] 4,427,957

[45] Jan. 24, 1984

[54] SWITCH ASSEMBLY

[75] Inventor: Ryuichi Sato, Kyoto, Japan

[73] Assignee: Omron Tateisi Electronics Co., Kyoto, Japan

[21] Appl. No.: 339,292

[22] Filed: Jan. 15, 1982

[30] Foreign Application Priority Data

Jan. 16, 1981 [JP] Japan ..... 56-5595

[51] Int. Cl.[3] ..... H01H 83/00

[52] U.S. Cl. ..... 335/19; 200/181; 335/15

[58] Field of Search ..... 335/19, 15, 16, 195, 335/147; 200/181

[56] References Cited

U.S. PATENT DOCUMENTS

| | | | |
|---|---|---|---|
| 2,784,275 | 3/1957 | Senn | 335/19 |
| 3,263,042 | 7/1966 | Dyer et al. | 335/16 |
| 4,001,738 | 1/1977 | Terracol et al. | 335/16 |

FOREIGN PATENT DOCUMENTS

| | | | |
|---|---|---|---|
| 553694 | 4/1977 | U.S.S.R. | 335/19 |

*Primary Examiner*—Harold Broome

*Attorney, Agent, or Firm*—Wegner & Bretschneider

[57] ABSTRACT

A switch asembly includes first and second contact members which are operatively provided to take one of two positions, a break-position in which the first and second contact members are separated from each other, and a make-position in which the first and second contact members are electrically connected with each other. Magnetic members are provided operatively in association with the first and second contact members to define a closed magnetic loop with a current path extending through the loop, when the first and second contact members are turned to the make-position. The magnetic members attract each other by the magnetic flux through the closed loop to maintain the first and second contacts in the make-position when the current flowing through the current path is not zero. Thus, the first and second contact members are permitted to return to the break-position at a zero crossing point of a.c. current flowing through the contacts.

34 Claims, 23 Drawing Figures

SWITCH ASSEMBLY

The present invention relates to a switch assembly and, more particularly, to an improved switch assembly capable of being used for cutting and supplying high a.c. power.

When a switch assembly having at least one pair of contacts transmits a high a.c. power, the current flowing through the switch assembly varies from positive maximum point through a zero crossing point to a negative maximum point and vice versa as in a sinusoidal waveform. When the switch assembly cuts, or breaks, the current at the zero crossing point, the contacts may separate away from each other without producing any arc. On the contrary, when the current is cut at a moment other than the zero crossing point, an arc may be produced between the contacts, and this possibility is high as the cutting is effected closer to the maximum point of the a.c. current. If the arc is once produced, it continues until the next zero crossing point comes.

When the arc is produced, it results in various disadvantages, such as increase of temperature, generation of poisonous gas, and dissolution of contacts.

In order to avoid the generation of arc, one may use a phase detector in combination with a switch assembly to effecting the cutting of the switch assembly in synchronized relation to the detection of zero crossing point by the phase detector.

This arrangement, however, results in bulky in size and high manufacturing cost.

Accordingly, it is a primary object of the present invention to provide an improved switch assembly which substantially breaks the contacts at the zero crossing point without employing any electrical phase detector.

It is another object of the present invention to provide an improved switch assembly of the above described type which is simple in construction and can be readily manufactured at low cost.

In accomplishing these and other objects, a switch assembly according to the present invention comprises first and second contact means provided operatively to take one of two positions, a break-position in which the first and second contact means are electrically separated from each other, and a make-position in which the first and second contact means are electrically connected with each other to define a current path therethrough, first and second magnetic bodies provided operatively in association with said first and second contact means such that said first and second magnetic bodies define at least one closed magnetic loop with at least one of said first and second contact means passing through said closed magnetic loop when said first and second contact means are turned to said make-position, and said magnetic loop opens when said first and second contact means are turned to said break-position, biasing means for biasing said first and second contact means towards said break-position, and actuating means for actuating said first and second contact means towards said make-position against said biasing means.

These and other objects and features of the present invention will become apparent from the following description taken in conjunction with preferred embodiments thereof with reference to the accompanying drawings, in which.

Figure 1:
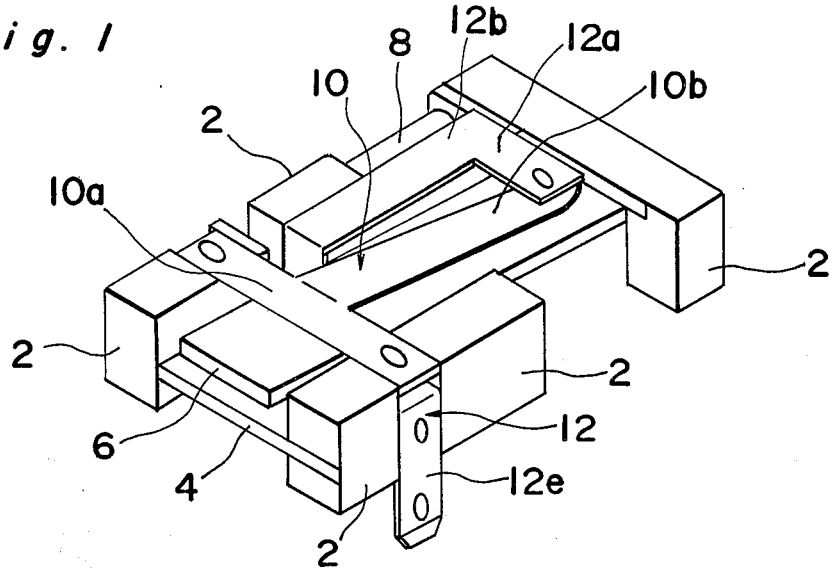
FIG. 1 is a perspective view of a switch assembly according to a first embodiment of the present invention.

Referring to FIG. 1, there is shown a switch assembly of a first embodiment according to the present invention. The switch assembly of the first embodiment comprises a framework 2 made of electrically non-conductive material, such as synthetic resin, a yoke 4 made of magnetic material, such as iron, and rigidly supported by the frame 2, a see-saw plate 6 made of magnetic material, such as iron, and rotatably supported by the frame 2, a coil 8 mounted on the yoke 4, and first and second contact members 10 and 12 which are electrically insulated from each other and from the yoke 4 and see-saw plate 6. The structure of the switch assembly of the first embodiment is described in detail below with reference to FIG. 2 schematically showing the switch assembly without the framework 2 and FIG. 3 showing a cross-sectional view taken along a line III—III shown in FIG. 2.

Figure 2:
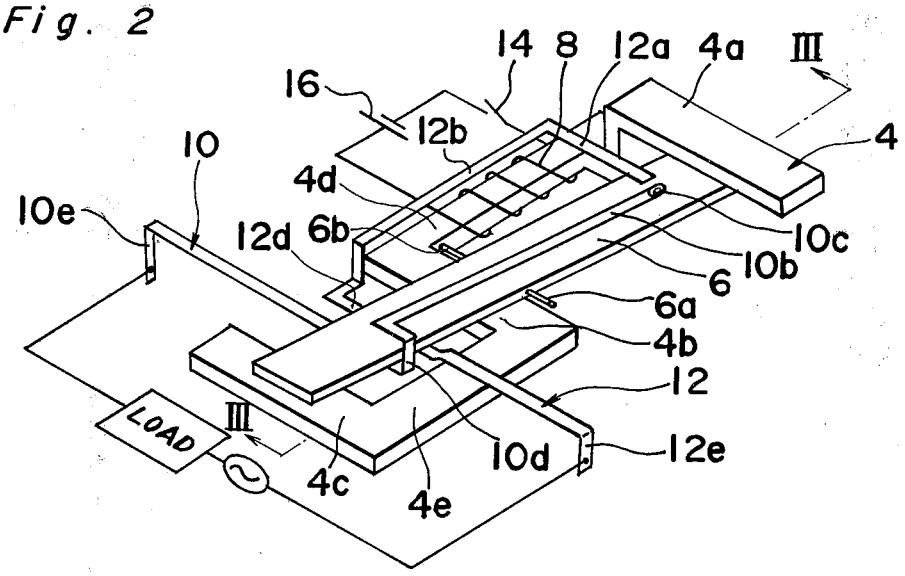
FIG. 2 is a diagrammatic view of a switch assembly of FIG. 1 with a framework being removed.
Figure 3:
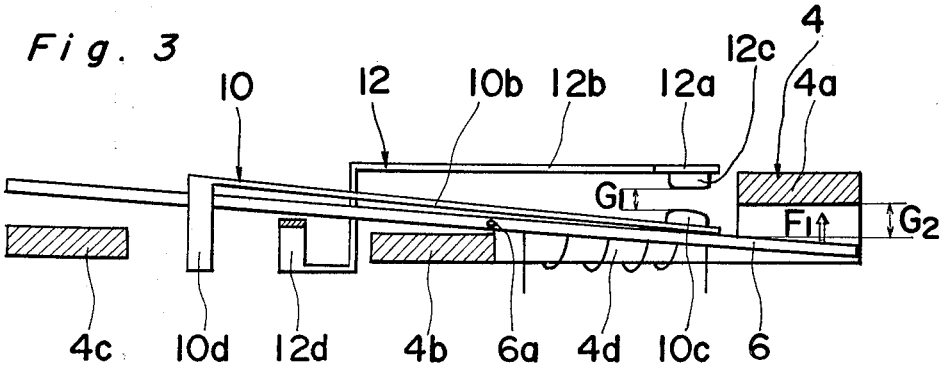
FIG. 3 is a cross-sectional view taken along a line III—III shown in FIG. 2.

The yoke 4, as best shown in FIG. 2, has an "S" shape configuration defined by three horizontal bars 4*a*, 4*b* and 4*c* aligned parallelly to each other and two vertical bars 4*d* and 4*e*. As apparent from FIGS. 2 and 3, the bars 4*b*, 4*c*, 4*d* and 4*e* extend in the same plane, whereas the bar 4*a* extends above said plane.

The coil 8 is mounted on the bar 4*d* of the yoke 4 and is electrically connected to a switch 14 and a power source 16 in series. The power source 16 shown in FIG. 2 is a d.c. power source, such as a battery, but it can be an a.c. power source. The coil 8 is provided for magnetizing particularly the bars 4*a* and 4*b* of the yoke 4 when the switch 14 is closed.

The see-saw plate 6 is so long that its one end locates under the bar 4*a* and the other end locates above the bar 4*c* of the yoke 4. A pair of pins 6*a* and 6*b* are provided approximately at the center of the see-saw plate 6 for the engagement with corresponding recesses or openings (not shown) formed in the framework 2 so that the see-saw plate 6 may rotate about the pins 6*a* and 6*b*. The clockwise rotation of the see-saw plate 6 is restricted by the framework 2 to terminate in a position shown in FIG. 3. On the other hand, the counterclockwise rotation of the see-saw plate 6 is restricted by the contact members 10 and 12 as will become apparent from the description below.

The first contact member 10 has a "T" shaped portion, as shown in FIG. 1, defined by arms 10*a* and 10*b* such that the arm 10*b* extends perpendicularly from the center of the arm 10*a*. The opposite ends of the arm 10*a* of the contact member 10 are rigidly supported by the framework 2 and the arm 10*b* extends over the see-saw plate 6. The arm 10*b*, serving as a leaf spring, is slightly bent downwardly with respect to the arm 10*a* so that the end of the arm 10*b* remote from the arm 10*a* contacts and pushes the see-saw plate 6 to the position shown in FIG. 3. A contact point 10*c* is mounted on the end portion of the arm 10*b*, as best shown in FIG. 3. Since there is no framework 2 shown in FIGS. 2 and 3, the arm 10*a* of the contact member 10 is not apparently shown in these FIGS. 2 and 3.

The first contact member further includes an arm 10*d* connected to the arm 10*a* and extends in a space between the see-saw plate 6 and bar 4*e* of the yoke 4 and further extends in the direction away from the bar 4*e* under the see-saw plate 6, and terminates to a terminal leg 10*e* for the external connection.

The second contact member 12 has an "L" shaped portion, as shown in FIGS. 1 and 2, defined by arms 12*a* and 12*b*. A contact point 12*c* is mounted on the end portion of the arm 12*a* in face-to-face relation with the contact point 10*c*. Since the arms 12*a* and 12*b* are made of hard metallic plate and are rigidly supported by the frame 2, the arm 12*a* stops the rotation of see-saw plate 6 upon contact of the contact points 10*c* and 12*c* with a very small degree of bending of the arms 12*a* and 12*b*.

The contact member 12 further includes an arm 12*d* connected to the arm 12*b* and extends, as best shown in FIG. 2, towards the bar 4*e* of the yoke 4 under the see-saw plate 6. The arm 12*d* further extends upwardly in a space between the see-saw plate 6 and the bar 4*e* and yet further extends above and across the bar 4*e* towards a terminal leg 12*e* for the external connection.

It is to be noted that the portions 10*d* and 12*d* of the contact members 10 and 12 pass through said space between the see-saw plate 6 and the bar 4*e* in such a manner that, when the contact points 10*c* and 12*c* contact, the currents in said portions 10*d* and 12*d* blow simultaneously in the same direction.

It is to be noted that, when the switch assembly described above is in an inoperative position as shown in FIG. 3, a gap G1 between contact points 10*c* and 12*c* is smaller than a gap G2 between see-saw plate 6 and bar 4*a* of the yoke 4. Thus, when the above described switch assembly of the first embodiment is turned to an operative position to establish a contact between the contact points 10*c* and 12*c*, the see-saw plate 6 and the bar 4*a* of the yoke 4 are maintained apart from each other, e.g., by 0.2 to 0.3 mm.

The switch assembly described above is particularly designed for use in switching a high power load actuated by an a.c. power source. FIG. 2 shows a load and an a.c. power source externally connected in series between the terminal legs 10*e* and 12*e*.

Figure 4:
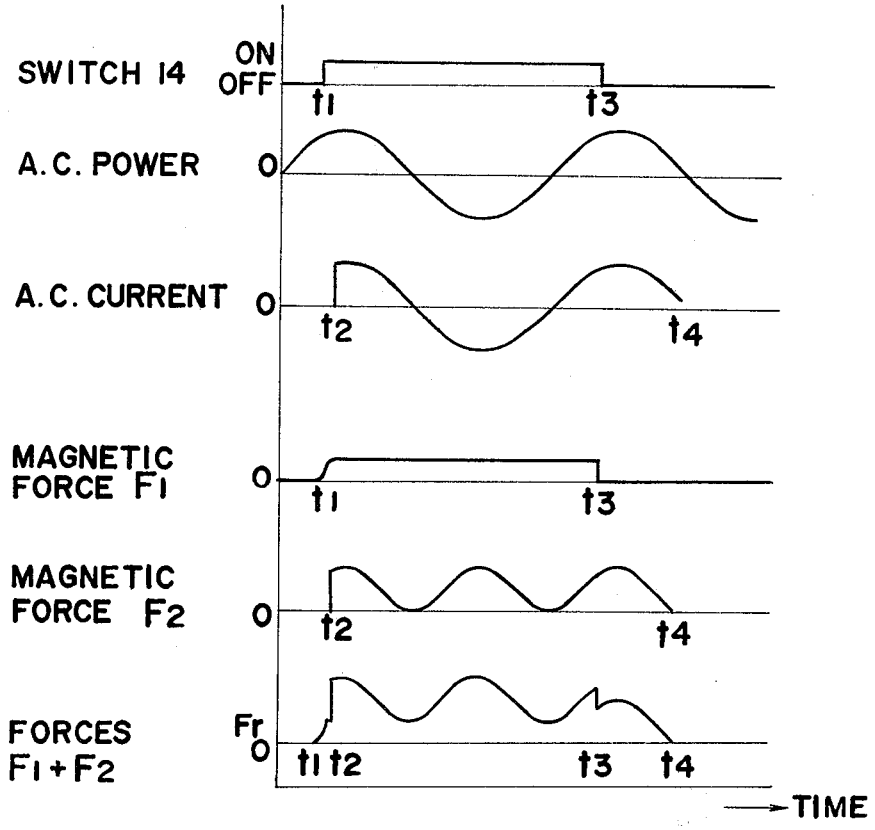
FIG. 4 is a graph showing operating condition of the switch assembly according to the present invention in timed relation.

Next, the operation of the switch assembly of the first embodiment is described with reference to a time chart shown in FIG. 4.

When the switch 14 is turned on at a moment t1, the coil 8 is excited to magnetize the yoke 4, particularly the bar 4*a*. Thus, a magnetic force F1 (FIG. 3) appears in the bar 4*a* attracting the see-saw plate 6. Therefore, the see-saw plate 6, which has been in the position shown in FIG. 3, starts to turn counterclockwise until the contact points 10*c* and 12*c* contact with each other, i.e., at a moment t2. Even after the contact points 10*c* and 12*c* contact, a narrow gap is present between the see-saw plate 6 and the bar 4*a* of the yoke 4 with the attractive force F1 exerting on the see-saw plate 6. Thus, a predetermined contact pressure between the contact points 10*c* and 12*c* can be obtained by the attractive force F1.

The counterclockwise rotation of the see-saw plate 6 not only results in contact between the contact points 10*c* and 12*c*, but also in contact between see-saw plate 6 and each of bars 4*b* and 4*c* of the yoke 4, establishing a closed magnetic loop through the bars 4*b*, 4*e* and 4*c* and the see-saw plate 6.

Thus, when the see-saw plate 6 is rotated counterclockwise to make contact between the contact points 10*c* and 12*c* and to establish the closed magnetic loop at the moment t2, a.c. current flows through the contact members 10 and 12 from the a.c. power source. (A waveform of a.c. power is shown in FIG. 4.) Since the portions 10*d* and 12*d* of the contact members 10 and 12, respectively, pass through the closed magnetic loop, a magnetic flux appears in the closed magnetic loop proportionally to the current flowing through the contact members 10 and 12. A waveform of the current flowing through the contact members 10 and 12 is shown in FIG. 4. Thus, by the generated magnetic flux, an attractive force F2 appears between the see-saw plate 6 and the yoke 4, particularly the bars 4*b* and 4*c*. As apparent to those skilled in the art, the magnetic force F2 will be maximum at the peaks of the a.c. current and will be zero at the zero crossing point of the a.c. current. A waveform of the magnetic force F2 is shown in FIG. 4. This magnetic force F2 aids the above mentioned magnetic force F1, thus, the contact pressure between the contact points 10*c* and 12*c* is further reinforced. In other words, the contact pressure is effected by the sum of the forces F1 and F2. A waveform of the forces F1 and F2 added with each other is shown in FIG. 4.

This reinforcement has such an advantage that the contact pressure required between the contact points 10*c* and 12*c* is obtained by the sum of the forces F1 and F2, and accordingly, the force F1 can be presented less than that needed to produce the required contact pressure, resulting in compact size of the coil 8.

Thereafter, when it is required to break the contacts 10*c* and 12*c*, the switch 14 is turned off at a moment t3. Accordingly, the magnetic force F1 disappears at the moment t3, and only the magnetic force F2 is present thereafter. If, at the moment t3, a.c. current from the a.c. power is relatively high either in positive or negative region, the magnetic force F2 is also relatively high, thus maintaining the see-saw plate 6 in contact with the bars 4*b* and 4*c* of the yoke 4, that is, maintaining the contact points 10*c* and 12*c* in contact with each other. Then, within the half cycle of the a.c. current, the current level becomes as small as zero level, and accordingly, the magnetic force F2 also becomes zero. During this half cycle, the biasing force of the leaf spring or arm 10*b* urging the see-saw plate 6 clockwise exceeds the force F2 for effecting the clockwise rotation of the see-saw plate 6 towards inoperative position, and thus substantially breaking the contacts 10*c* and 12*c*. In the time chart of FIG. 4, it is seen that the contacts 10*c* and 12*c* break at a moment t4, at which the level of the a.c. current is very low. Thus, when the contacts 10*c* and 12*c* separate away from each other, this separation breaks very small amount of current resulting in no arc between the contacts 10*c* and 12*c*. The inertia moment of the contact 10*c* and its associated parts that move together with the contact 10*c* further delays the separation, reaching closer to the zero crossing point of the a.c. current.

Since the switch assembly according to the present invention breaks the contact approximately at the zero crossing point of the a.c. current, no arc is produced, and accordingly, various disadvantages caused by the arc producing can be avoided. For example, the increase of temperature, generation of poisonous gas, and dissolution of contact points can be avoided.

Although the contact points 10*c* and 12*c* may erode slightly after many operations, this results merely in the reduction of the narrow gap produced between the see-saw plate 6 and the bar 4*a* of the yoke 4 when the switch assembly is in the operative position.

It is to be noted that the coil 8 defining an electromagnet together with the bars 4*a* and 4*d* for producing the force F1 may be replaced with any other means for actuating the see-saw plate 6, such as a push button or a device using piezoelectric effect as employed in the embodiments described later.

Figure 5:
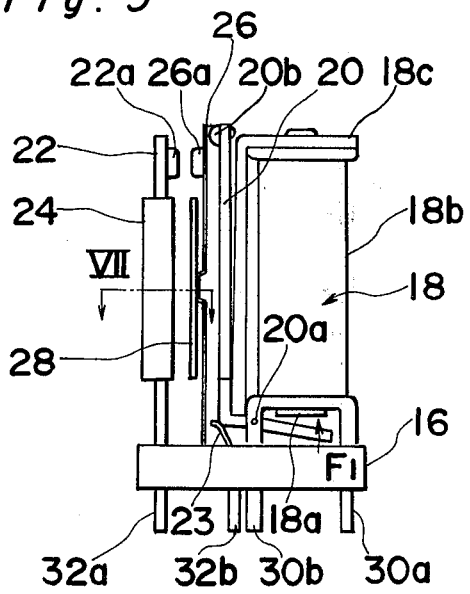
FIG. 5 is a side view of a switch assembly according to a second embodiment of the present invention.

Referring to FIG. 5, there is shown a switch assembly according to a second embodiment of the present invention. The switch assembly of the second embodiment comprises a base 16 on which an electromagnet 18 is rigidly mounted. The electromagnet 18 includes a core 18*a*, a coil 18*b* and a frame 18*c*. Operatively provided to the electromagnet 18 is an "L" shaped lever 20 made of iron and pivotally supported at 20*a*. The lever 20 has one end portion provided with an electrically insulating material 20*b* and the other end portion located in a position capable of being affected by the magnetic force F1 of the electromagnet 18. A leaf spring 23 is mounted on the base 16 for pushing the corner of the "L" shaped lever 20. Thus, the lever 20 is normally rotated clockwise by the leaf spring 23 and is held in a position as shown in FIG. 5.

Figure 6:
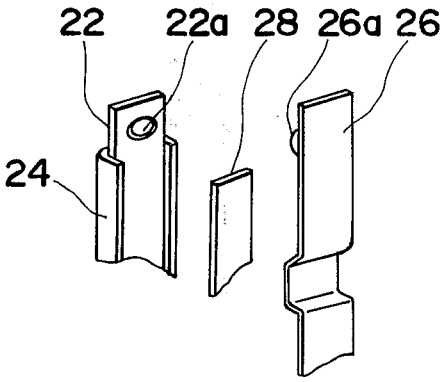
FIG. 6 is an exploded view partly showing first and second contact members and first and second magnetic members.
Figure 7:
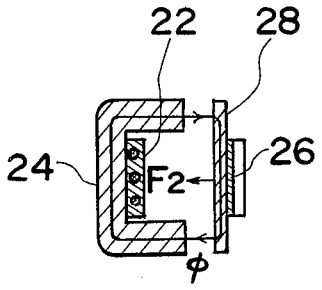
FIG. 7 is a cross-sectional view taken along a line VII shown in FIG. 5.

The switch assembly of the second embodiment further comprises a first contact member 22 made of rigid conductive material, such as iron, and fixedly mounted on the base 16. The first contact member 22 has a contact point 22*a* rigidly mounted at its one end remote from the base 16. A first magnetic member 24 made of magnetic material and having a "U" shape cross section, as best shown in FIGS. 6 and 7, is rigidly attached to an intermediate portion of the first contact member 22 through a suitable insulator, such as epoxy synthetic resin.

A second contact member 26 made of resilient conductive material, such as a thin iron plate, is fixedly mounted on the base 16 at a position between the first contact member 22 and the lever 20. The second contact member 26 has a contact point 26*a* rigidly mounted at its one end remote from the base 16 in such a manner that the contact point 26*a* faces the contact point 22*a*. Normally, the contact points 22*a* and 26*a* are spaced apart from each other, as shown in FIG. 5. A second magnetic member 28 made of magnetic material is attached to an intermediate portion of the second contact member 26, preferably through an insulator.

It is to be noted that the first and second magnetic members 24 and 28 are so arranged that, when the second contact member 26 is pushed towards the first contact member 22 against the resiliency of the second contact member 26 to make contact between contact points 22*a* and 26*a*, the first and second magnetic members 24 and 28 contact with each other to define a tubular member in which the first contact member 22 passes through.

The base 16 is further mounted with terminal legs 30*a*, 30*b*, 32*a* and 32*b*, in which the terminal legs 30*a* and 30*b* are connected to the coil 18*b* of the electromagnet 18, and the terminal legs 32*a* and 32*b* are connected, respectively, to the first and second contact members 22 and 26. Although not shown in FIG. 5, it is understood from the previous embodiment that the terminal legs 30*a* and 30*b* are provided for the connection with switch and d.c. or a.c. source in series, and the terminal legs 32*a* and 32*b* are provided for the connection with a load and a.c. source of high power.

Next, the operation of the switch assembly of the second embodiment is described with reference to FIG. 4.

When the switch is turned on at the moment t1 to excite the electromagnet 18, the "L" shaped lever 20 is turned counterclockwise against the force of leaf spring 23 and resiliency of the contact member 26 by the magnetic force F1 exerting on the lever 20. Thus, at the moment t2, the contact points 22*a* and 26*a* make contact and, at the same time, the first and second magnetic members 24 and 28 contact each other to define the tube. Thus, a.c. current flows through the contact members 22 and 26. By the current flowing through the contact member 22, a magnetic flux $\phi$ appears in a closed magnetic loop defined in the tube, as shown in FIG. 7. The magnetic flux $\phi$ gives rise to attractive force F2 between the magnetic members 24 and 28 in such a manner as to aid the contact pressure between the contact points 22*a* and 26*a*. Accordingly, the contact pressure exerting on the contact member 26 is effected by the sum of forces F1 and F2.

Then, at the moment t3, the electromagnet 18 is deenergized by the opening of the switch, and accordingly, the force F1 disappears, and thereafter, the second contact member 26 is biased only by the force F2. When the force F2 is reduced to about zero (moment t4), i.e., when the a.c. current reaches closed to the zero crossing point, the second contact member 26 separates away from the first contact member 22 by the force of leaf spring 22 and the resiliency of the contact member 26. Since a.c. current flow through the contact members 22 and 26 at the moment t4 is very low, no arc will be produced during the separation of the contact points 22*a* and 26*a*.

Figure 8:
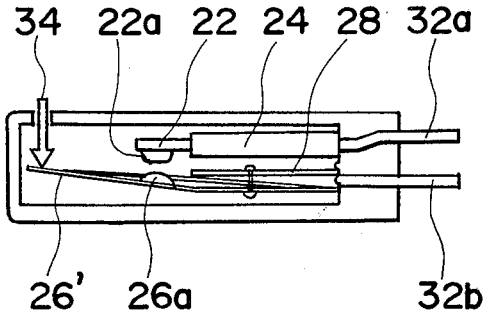
FIG. 8 is a diagrammatic view of a modification of the second embodiment.

Referring to FIG. 8, there is shown a modification of the switch assembly of the second embodiment. Instead of the electromagnet, the modification shown employs a push button which is diagrammatically depicted by an arrow 34. Furthermore, the contact member 26' shown is a snap action type capable of producing a predetermined contact pressure when the push button 34 is depressed.

Figure 9:
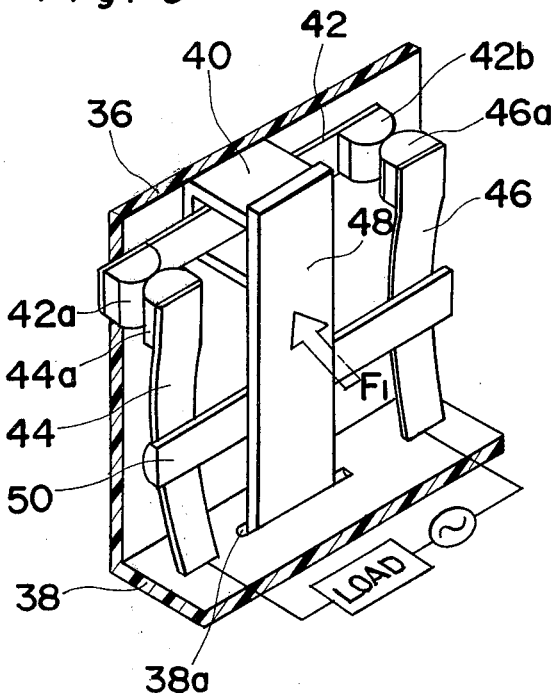
FIG. 9 is a perspective view showing major parts of a switch assembly according to a third embodiment of the present invention.

Referring to FIG. 9, there is shown a switch assembly according to the third embodiment of the present invention. The switch assembly according to the third embodiment is a double make-and-break switch and it comprises an "L" shaped wall defined by an upright wall 36 and base wall 38 which are connected in right angle to each other. A "U" shaped magnetic member 40 is fixedly mounted on the upright wall 36 such that the opposite side faces or walls of the "U" shaped magnetic member 40 extend away from the upright wall 36 and a groove defined in the "U" shaped magnetic member 40 extends parallelly to the corner between the upright and base walls 36 and 38. A first contact member 42 having contact points 42*a* and 42*b* at its opposite ends, respectively, is fixedly connected to the "U" shaped magnetic member 40 through a suitable insulator such that the elongated first contact member 42 extends through the groove of the "U" shaped magnetic member 40. A pair of second contact members 44 and 46 made of resilient conductive material are rigidly mounted on the base plate 38. The second contact members 44 and 46 have at their respective free ends contact points 44*a* and 46*a* which are in face-to-face relation with the contact points 42*a* and 42*b*, respectively, of the first contact member 42. It is to be noted that the contact points 44*a* and 46*a* are normally held away from the contact points 42*a* and 42*b*, respectively. The base wall 38 is formed with an elongated recess 38*a* which is located between the second contact members 44 and 46 and extends parallelly to the corner between the upright and base walls 36 and 38. The elongated recess 38*a* is provided for pivotally receiving a plate 48 made of magnetic material. The plate 48 is so long that its free end remote from the base wall 38 can contact the free end of the "U" shaped magnetic member 40.

Figure 10:
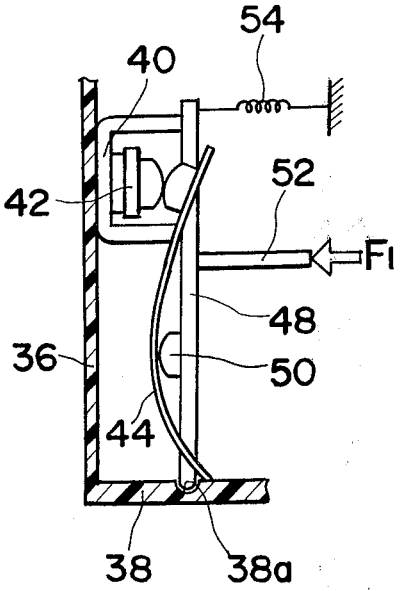
FIG. 10 is a side view of the switch assembly shown in FIG. 9.
Figure 11:
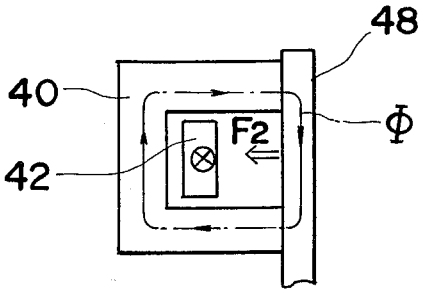
FIG. 11 is a diagrammatic view showing a closed magnetic loop defined in the switch assembly of FIG. 9.

A card, or bar, 50 has its intermediate portion connected or rigidly secured to the plate 48 with its opposite end portions aligned respectively with the contact members 44 and 46 on one side thereof opposite to the side provided with the contact points 44*a* and 46*a* such that, when the external pushing force F1 indicated by an arrow is applied to the plate 48 through a suitable member 52 (FIG. 10) against the force of a spring 54, the plate 48 pivots about the elongated recess 38*a* towards the "U" shaped magnetic member 40, and by the bar 50, the contact members 44 and 46 can be pushed towards the first contact member 42. The resultant is such that the contact points 44*a* and 46*a* make contact with contact points 42*a* and 42*b*, respectively, and at the same time, the plate 48 contacts the "U" shaped magnetic member 40, as best shown in FIG. 11. Accordingly, when the contact is made, a closed magnetic loop is formed between the "U" shaped magnetic member 40 and the plate 48.

It is to be noted that the member 52 connected to the plate 48 is provided operatively in association with a suitable actuating means, such as a push button, electromagnet or the like for applying the pushing force F1 to the plate 48.

As diagrammatically shown in FIG. 9, the contact members 44 and 46 are electrically connected with a load and an a.c. power source in series.

The operation of the switch assembly of the third embodiment is as follows.

When the plate 48 is pushed by the force F1, the contact points 42*a* and 42*b* make contact with contact points 44*a* and 46*a*, respectively to permit a.c. current flow through contact members 44, 42 and 46. Simultaneously with the above, a magnetic flux $\phi$ appears in the closed magnetic loop through the "U" shaped magnetic member 40 and the plate 48, as shown in FIG. 11. Accordingly, the member 40 and the plate 48 are attracted with each other by a magnetic force F2, as shown in FIG. 11.

Then, when the biasing force F1 is removed, e.g., by stopping the depression of a push button (not shown), only the magnetic force F2 is present. This magnetic force F2 decreases to zero within a half cycle of a.c. power, and accordingly, the contact points break in a similar manner described above, without producing any arc.

Since the switch assembly according to the third embodiment of the present invention is a double make-and-break switch, the sum of gaps between contact points 44*a* and 42*a* and between contact points 46*a* and 42*b* would be the required contact gap, and therefore, the stroke length of the contact members 44 and 46 can be shortened, resulting in compact size of the switch assembly.

Figure 12:
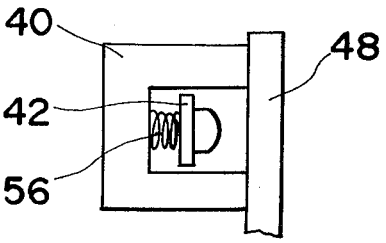
FIG. 12 is a diagrammatic view of a modification of the third embodiment and particularly showing a modified portion.

It is to be noted that the first contact member 42 can be connected to the "U" shaped magnetic member 40 through a suitable biasing means, such as a spring 56 as shown in FIG. 12, for increasing the contact pressure between the contact points 44*a* and 42*a* and between contact points 46*a* and 42*b*.

Figure 13:
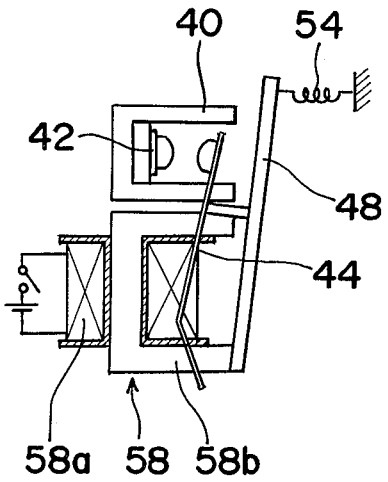
FIG. 13 is a diagrammatic view of another modification of the third embodiment.

Referring to FIG. 13, there is shown a modification of the switch assembly of the third embodiment. The switch assembly shown employs an electromagnet 58 as the actuating means for applying the biasing force F1 to the plate 48. The electromagnet 58 includes a coil 58*a* and a core 58*b* formed in a shape of "U". Instead of being pivotally supported in the elongated recess 38*a*, the lower end of the plate 48 is hinged to the edge of the core 58*b*.

Figure 14:
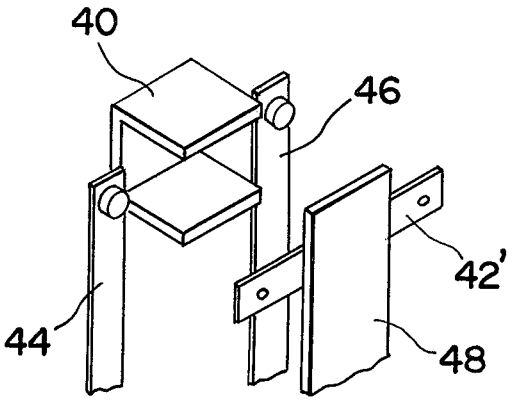
FIG. 14 is a diagrammatic view of a further modification of the third embodiment and particularly showing a modified portion.

Referring to FIG. 14, there is shown another modification of the switch assembly of the third embodiment. According to the switch assembly shown, the first contact member 42' is rigidly secured to the plate 48. Accordingly, the first contact member 42 is placed inside the groove of the "U" shaped magnetic member 40 only when the contacts are made.

Figure 15:
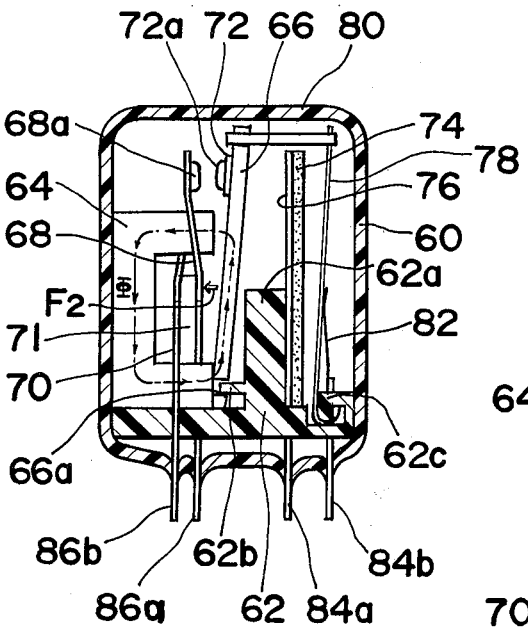
FIG. 15 is a side view of a switch assembly according to the fourth embodiment of the present invention.

Referring to FIG. 15, there is shown a switch assembly according to a fourth embodiment of the present invention. The switch assembly shown is a double make-and-break switch and it includes an air tight casing 60 made of, e.g., glass or synthetic resin, and a base 62 made of electrically non-conductive material, such as synthetic resin. The base 62 is secured inside and at the bottom portion of the casing 60. The base 62 has an upright wall 62*a* standing approximately at the center of the base 62 and a projection 62*b* extending from the upright wall 62*a*. The base 62 further has a hook 62*c* formed, when viewed in FIG. 15, at right-hand side thereof.

A first magnetic member 64 made of magnetic material and having a "U" shaped configuration defined by upper and lower arm portions is fixedly mounted on the base 62 with the upper and lower arm portions directing towards the upright wall 62*a*. A second magnetic member 66 having a recess 66*a* formed in its one end portion is positioned operatively in association with the first magnetic member 64 such that the recess 66*a* loosely engages with the projection 62*b*. Thus, the second magnetic member 66 may pivot about the projection 62*b* between a first pivoted position in which the second magnetic member 66 separates away from the first magnetic member 64, particularly from the upper arm portion of the magnetic member 64, as shown in FIG. 15, and a second pivoted position in which the second magnetic member 66 abuts against the first magnetic member 64 to define a closed magnetic loop.

Figure 16:
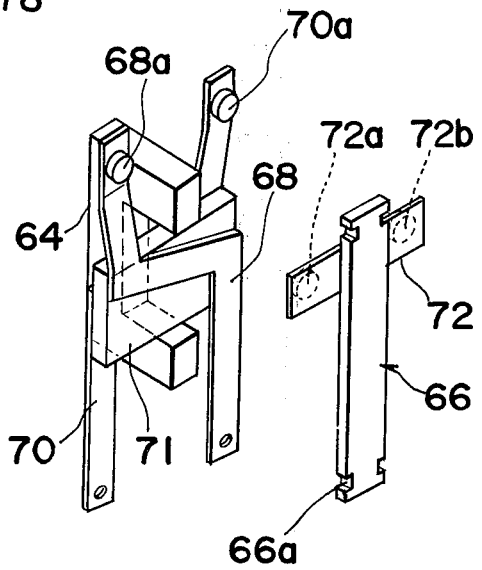
FIG. 16 is a perspective view particularly showing relationship among first and second contact members and first and second magnetic members of the switch assembly of FIG. 15.
Figure 17:
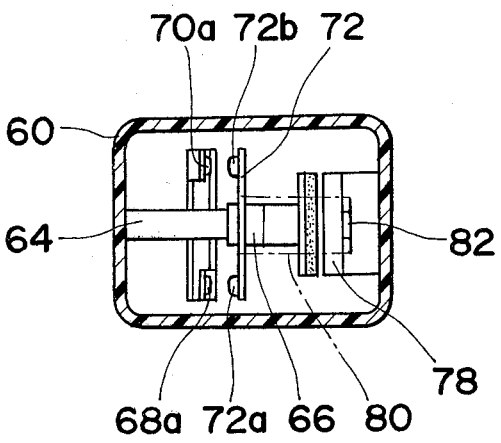
FIG. 17 is a top view of a switch assembly of FIG. 15.

A pair of first contact members 68 and 70 are fixedly mounted on the base 62 adjacent and on opposite sides, respectively, of the base 62. As best shown in FIG. 16, the contact member 68 extends through the groove of the "U" shaped magnetic member 64 and appears on the other side of the "U" shaped magnetic member 64. Similarly, the other contact member 70 passes through the groove of the "U" shaped magnetic member 64. In other words, the contact members 68 and 70 intersect with each other in the groove of the "U" shaped magnetic member 64. For preventing a contact between the contact members within the groove of the "U" shaped magnetic member 64, an insulation plate 71 is positioned between the contact members 68 and 70. At the ends of the contact members 68 and 70 remote from the base 62, contact points 68*a* and 70*a* are fixedly mounted.

A second contact member 72 is rigidly secured to the second magnetic member 66 with opposite end portions aligned respectively with the contact points 68*a* and 70*a*. Accordingly, a pair of contact points 72*a* and 72*b* fixedly mounted at opposite end portions of the second contact member 72 align in face-to-face relation with contact points 68*a* and 70*a*, respectively.

An electret 74 deposited with a first electrode 76 is fixedly attached to the upright wall 62*a* on a side opposite to the side provided with the projection 62*b* with said first electrode 76 being on a side touching the upright wall 62*a*. A second electrode 78 made of rigid but thin film plate, such as an aluminum plate, is operatively provided in association with the electret 74 in such a manner that the lower end of the second electrode 78 is pivotally engaged to the hook 62*c* of the base 62 and its upper end is linked with the second magnetic member 66 through a suitable arm 80 made of non-magnetic and non-conductive material. A biasing means, such as a leaf spring 82 is connected to the second electrode 78 for urging the second electrode 78 away from the electret 74.

Figure 18:
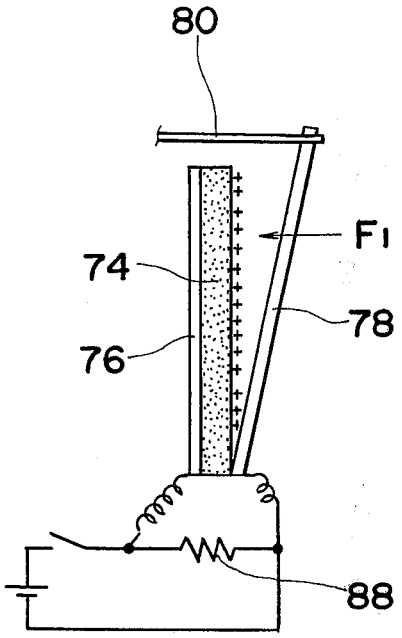
FIG. 18 is a diagrammatic view of an electret employed in the switch assembly of FIG. 15.

The switch assembly of the fourth embodiment further includes terminal legs 84*a*, 84*b*, 86*a* and 86*b* in which the terminal legs 84*a* and 84*b* are connected to the first and second electrodes 76 and 78, respectively, and the terminal legs 86*a* and 86*b* to the contact members 68 and 70, respectively. The terminal legs 84*a* and 84*b* are externally connected with a switch and a d.c. or a.c. source in series and the terminal legs 86*a* and 86*b* are externally connected with a load and an a.c. power source in series, in a similar manner to that shown in FIG. 2. The terminal legs 84*a* and 84*b* may be further connected with a discharging resistance 88, as shown in FIG. 18.

In order to reduce the possibility of producing any arc, the casing 60 is made vacuum or is filled with inactive gas, such as $SF_6$ (sulfur hexafluoride).

Next, the operation of the switch assembly according to the fourth embodiment is described.

When the switch is closed to supply d.c. voltage between the terminal legs 84*a* and 84*b*, the second electrode 78 receives attractive force F1 (FIG. 18) towards the electret 74 by the electrostatic charge appearing on the electret 74. Accordingly, the second electrode 78 pivots leftwardly about the hook 62*c*, and thus, it pushes the second magnetic member 66 leftwardly towards the second pivoted position mentioned above. When the second magnetic member 66 is turned to the second pivoted position, it not only contacts with the first magnetic member 64 to define a closed magnetic loop but also makes a contact between contact points 68*a* and 72*a* and between contact points 70*a* and 72*b*. Accordingly, a.c. current flows through the contact members 68, 72 and 70 to supply a.c. power to the externally connected load. Since the contact members 68 and 70 passes through the closed magnetic loop defined by the magnetic members 64 and 66, and since the direction of currents flowing through the contact members 68 and 70 at the closed magnetic loop is the same, such currents give rise to magnetic flux $\phi$ through the closed magnetic loop. Accordingly, the first and second magnetic members 64 and 66 attract each other by a magnetic force F2, as indicated in FIG. 15.

Then, when the biasing force F1 is removed by turning the switch off, only the magnetic force F2 is present. This magnetic force F2 decreases to zero within a half cycle of a.c. power, and accordingly, the contact points break in a similar manner described above without producing any arc.

As will be understood to those skilled in the art, the electret 74 and its associated parts serve as an actuating means for actuating the contact members.

It is to be noted that the contact members 68 and 70, both of which have been described as passing through the groove of the "U" shaped magnetic member 64, may be so arranged as to render only one contact member 68 or 70 pass through said groove. Furthermore, at least one of the contact members 68 and 70 may be so arranged as to pass through the groove for a number of times. This can be accomplished by winding the contact member for a number of times on the "U" shaped magnetic member 64.

Since the switch assembly according to the fourth embodiment of the present invention has an air tight casing for keeping the contact members in a vacuum or in inactive gas, the insulation between contact points can be increased without widening the gap therebetween. Accordingly, the stroke length of the contact member 72 can be arranged to be very small. This is particularly suitable for use in a combination with the electret which can provide only a small stroke to the pivotally associated electrode.

Since the electret is small in size and consumes relatively low power, and since the stroke of the movable contact member is relatively short, the switch assembly according to the fourth embodiment can be prepared in a compact size and operated with less power.

Figure 19:
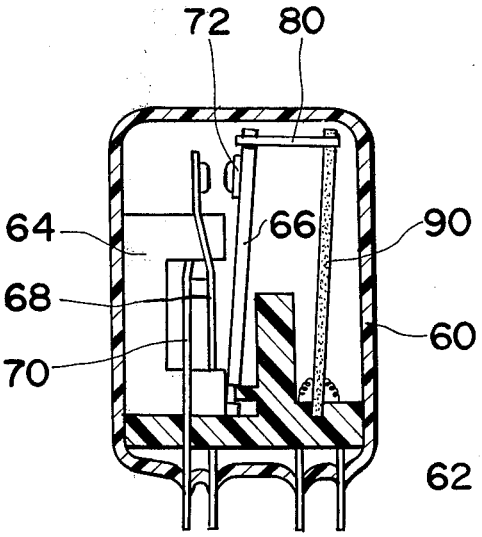
FIG. 19 is a view similar to FIG. 15, but particularly showing a modification thereof.
Figure 20:
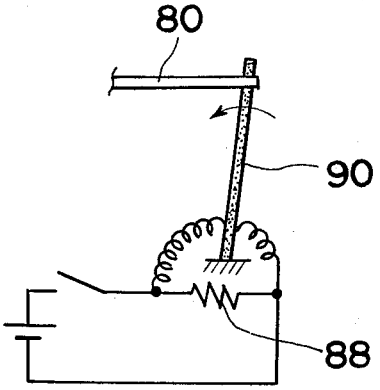
FIG. 20 is a diagrammatic view of a bimorph employed in the switch assembly of FIG. 19.

Referring to FIGS. 19 and 20, there is shown a modification of the switch assembly of the fourth embodiment. Instead of the electret, the switch assembly shown has a bimorph 90 which moves in a direction indicated by an arrow in FIG. 20 by the piezoelectric effect when d.c. voltage is applied thereto. Such a movement of the bimorph results in termination of the second magnetic member 60 to the second pivoted position. Thus, the modification shown operates in a similar manner to the switch assembly of the fourth embodiment and has the same meritorious effect as described above.

Figure 21:
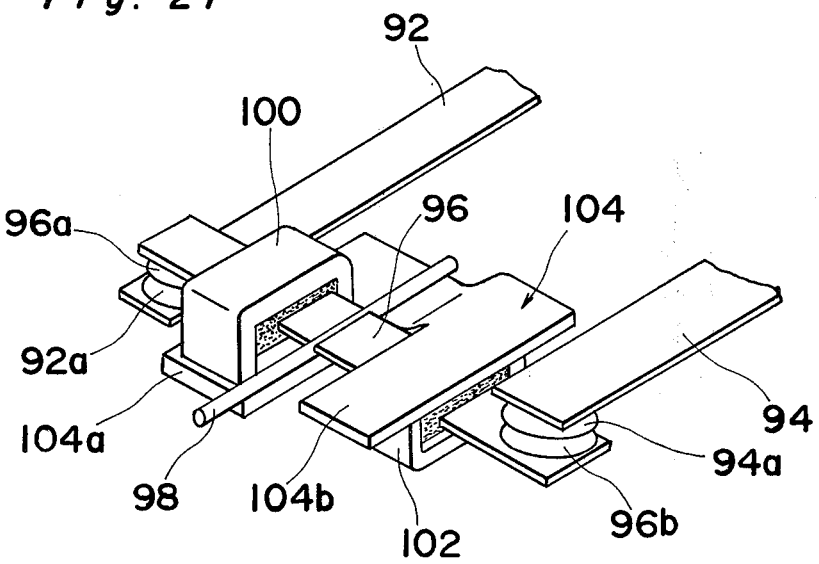
FIG. 21 is a perspective view of a major portion of a switch assembly according to a fifth embodiment of the present invention.

Referring to FIG. 21, there is shown a switch assembly according to a fifth embodiment of the present invention. The switch assembly shown is a double make-and-break switch and it includes stationarily provided contact members 92 and 94 having contact points 92*a* and 94*a*, respectively, at their end portions. As apparent from the drawings, the contact point 92*a* projects upwardly from the contact member 92 and the contact point 94*a* projects downwardly from the contact members 94. Another contact member 96 is fixedly connected to an axle 98 which is rotatably supported and positioned approximately at the center between the contact points 92*a* and 94*a*. The contact member 96 is so long that its opposite ends provided with contact points 96*a* and 96*b*, respectively, align with the contact points 92*a* and 94*a*. Since the contact points 96*a* and 96*b* are mounted on the opposite faces of the contact member 96, the contact points 96*a* comes into face-to-face contact with the contact point 92*a* and the contact point 96*b* comes into face-to-face contact with the contact point 94*a* when the contact member 96 is rotated counterclockwise about the axle 98.

The contact member 96 rigidly carries a "U" shaped magnetic member 100 at intermediate portion between the axle 98 and the contact point 96*a* such that the contact member 96 extends through the groove defined in the "U" shaped magnetic member 100 and the opposite parallel arms of the "U" shaped magnetic member 100 point in the same direction as the projecting direction of the contact point 96*a*, as shown in FIG. 21.

Similarly, another "U" shaped magnetic member 102 is rigidly carried by the contact member 96 at intermediate portion between the axle 98 and the contact point 96*b*. In this case, the parallel arms of the "U" shaped magnetic member 102 point in the same direction as the projecting direction of the contact point 96*b*. The mounting of the "U" shaped magnetic members 100 and 102 is effected by the injection of non-conductive and non-magnetic material, such as epoxy resin, in the groove of the "U" shaped magnetic members 100 and 102.

A stationary magnetic member 104 having bifurcated arms 104*a* and 104*b* is provided in association with the "U" shaped magnetic members 100 and 102 such that when the contact plate 96 is rotated counterclockwise to make contacts between the contact points 92*a* and 96*a* and between contact points 94*a* and 96*b*, the "U" shaped magnetic member 100, particularly the free ends of the opposite parallel arms of the "U" shaped magnetic member 100, abuts against the arm 104*a* of the bifurcated arms and, at the same time, the "U" shaped magnetic member 102 similarly abuts against the arm 104*b* of the bifurcated arms. Accordingly, one closed magnetic loop is defined by the "U" shaped magnetic member 100 and the arm 104*a*, and another closed magnetic loop is defined by the "U" shaped magnetic member 102 and the arm 104*b*.

Figure 23:
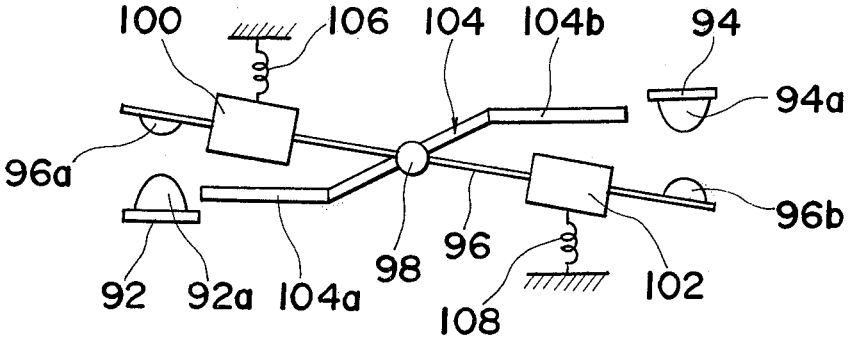

Normally, the contact member 96 and "U" shaped magnetic members 100 and 102 carried by the member 96 are held in a position shown in FIG. 23 by a suitable biasing means, such as springs 106 and 108. In this position, no closed magnetic loop is formed and facing contact points are separated away from each other.

Figure 22:
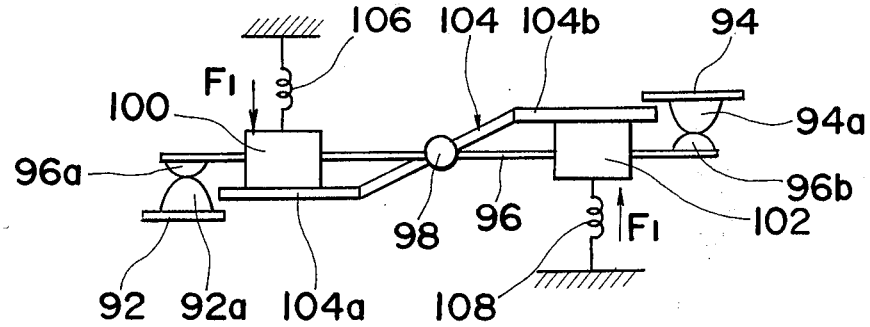
FIGS. 22 and 23 are diagrammatic views showing different operated positions of the switch assembly of FIG. 21.

The switch assembly according to the fifth embodiment further includes actuating means which exerts rotating force F1 on the contact member 96 or on at least one of "U" shaped magnetic members 100 and 102, as shown by arrows in FIG. 22, for actuating the contact member 96 to rotate couterclockwise about the axle 98 against the biasing force of the springs 106 and 108. Although any embodied form of such an actuating means is not shown in FIGS. 21 to 23, such an arrangement can be readily understood from the previous embodiments employing electromagnet, push button, electret or bimorph for the actuating means.

Next, the operation of the switch assembly according to the fifth embodiment of the present invention is described.

When the biasing force F1 pushes the contact member 96, the contact member 96 carrying the "U" shaped magnetic members 100 and 102 rotates counterclockwise from the position shown in FIG. 23 to the position shown in FIG. 22. Accordingly, a.c. current flows through contact members 92, 96 and 94. Simultaneously with the above, magnetic flux appears in the closed magnetic loop defined by the "U" shaped magnetic member 100 and arm 104*a* and also that defined by the "U" shaped magnetic member 102 and arm 104*b*. Thus, the "U" shaped magnetic member 100 and arm 104*a* are attracted with each other, and the "U" shaped magnetic member 102 and arm 104*b* are attracted with each other to aid the biasing force F1.

Then, when the biasing force F1 is removed, only the above mentioned attractive forces are present. These attractive forces decrease to zero within a half cycle of a.c. power, and accordingly, the contact points break in a similar manner described above without producing any arc to terminate the contact member 96 in the position shown in FIG. 23.

Since the switch assembly of the fifth embodiment is arranged symmetrically and well balanced about the axle 98, resistance against shock and vibration is improved.

As has been described in connection with several preferred embodiments, the switch assembly according to the present invention breaks the contact points approximately at the zero crossing point of the a.c. power without employing any electrical detecting means. Accordingly, switch assembly according to the present invention can break the contact points without producing any arc and yet can be assembled compact in size with a simple structure.

Although the present invention has been fully described with refernce to several preferred embodiments, many modifications and variations thereof will now be apparent to those skilled in the art, and the scope of the present invention is therefore to be limited not by the details of the preferred embodiments described above, but only by the terms of the appended claims.

What is claimed is:

1. A switch assembly comprising:

first and second contact means provided operatively to take one of two positions, a break-position in which the first and second contact means are electrically separated from each other, and a make-position in which the first and second contact means are electrically connected with each other to define a current path therethrough;

biasing means for normally holding said first and second contact means in said break-position;

first and second magnetic bodies provided operatively in association with said first and second contact means such that said first and second magnetic bodies define at least one closed magnetic loop with at least one of said first and second contact means passing through said closed magnetic loop when said first and second contact means are turned to said make-position, said magnetic loop opening when said first and second contact means are turned to said break-position; and coil means mounted on at least one of said first and second magnetic bodies for providing, when it is excited, a force against the force of the biasing means so as to establish the make-position.

2. A switch assembly comprising;

first and second contact means provided operatively to take one of two positions, a break-position in which the first and second contact means are electrically separated from each other, and a make-position in which the first and second contact means are electrically connected with each other to define a current path therethrough;

first and second magnetic bodies provided operatively in association with said first and second contact means such that said first and second magnetic bodies define at least one closed magnetic loop, with at least one of the first and second contact means passing through the closed magnetic loop when the first and second contact means are turned to the make-position, and such that the closed magnetic loop opens when the first and second contact means are turned to the break-position;

biasing means for biasing said first and second contact means towards said break-position; and actuating means for actuating said first and second contact means towards said make-position against said biasing means, wherein said first magnetic body substantially has an "S" shape configuration defined by first, second and third bars extending parallel to each other with the second bar positioned intermediately between the first and third bar and said first bar positioned above a plane in which the second and third bars are contained, and by a fourth bar connecting the first and second bars and a fifth bar connecting the second and third bars.

3. A switch assembly as claimed in claim 2, wherein said second magnetic body has an elongated plate configuration with its intermediate portion pivotally supported adjacent said second bar of said first magnetic body, said elongated second magnetic body having its first end portion located under said first bar and its second end portion located above said third bar, whereby when said elongated second magnetic body is rotated to narrow a gap between said first end portion and said first bar, said elongated second magnetic body and said second, third and fifth bars defining a closed magnetic loop.

4. A switch assembly as claimed in claim 3, wherein said first contact means comprises a first elongated contact member extending along a longitudinal direction of said elongated second magnetic body and passing through a space defined by said elongated second magnetic body and said second, third and fifth bars, and a first contact point mounted on the first elongated contact member at a position where said first elongated contact member is located adjacent to said first end portion of said elongated second magnetic body.

5. A switch assembly as claimed in claim 4, wherein said second contact member comprises a second elongated contact member extending through said space capable of effecting current flow through said space in the same direction as that flowing through said first elongated contact member when said first and second contact means are turned to said make-position, and a second contact point mounted on said second elongated contact member in such a manner as to locate said second contact point in face-to-face relation with said first contact point.

6. A switch assembly as claimed in claim 5, wherein said first and second contact points have a gap therebetween smaller than the gap between said first end portion and said first bar so as to maintain the gap between the first end portion and the first bar greater than zero even after the first and second contact points are contacted with each other.

7. A switch assembly as claimed in claim 4, wherein said biasing means is formed from a portion of said first elongated contact member that extends along a longitudinal direction of said elongated second magnetic body such that said portion of said first elongated contact member serves a as leaf spring for biasing said first end portion of said second magnetic body away from said first bar.

8. A switch assembly as claimed in claim 3, wherein said actuating means is an electromagnet comprising a coil wound on said fourth bar of said first magnetic body to produce an attractive force between said first bar of said first magnetic body and said first end portion of said elongated second magnetic body.

9. A switch assembly as claimed in claim 1, further comprising a base.

10. A switch assembly as claimed in claim 9, wherein said first contact means comprises an elongated and stationary first contact member having its first end rigidly mounted on said base, and a first contact point attached to said first contact member at its second end opposite to said first end.

11. A switch assembly as claimed in claim 10, wherein said second contact means comprises an elongated and movable second contact member having a first and second, opposite end, said first end being rigidly mounted on said base, and a second contact point being attached to said second contact member at its second end such that said first and second contact points are located in face-to-face relation with each other, said second contact member being movable between said break-position and said make-position.

12. A switch assembly as claimed in claim 11, wherein said first magnetic body has a "U" shape configuration having a groove defined therein, said first magnetic body being connected to said first contact member such that said first contact member extends through said groove.

13. A switch assembly as claimed in claim 12, wherein said second magnetic body has a plate configuration, said second magnetic body being connected to said second contact member so as to move together with said second contact member, said second magnetic body closing said groove to define a closed magnetic loop around said first contact member by said first and second magnetic bodies when said second contact member moves to said make-position, and opening said groove when said second contact member moves to said break-position.

14. A switch assembly as claimed in claim 11, wherein said actuating means comprises an electromagnet and a lever which moves upon the actuation of said electromagnet, said lever being adapted to push said second contact means to said make-position when said electromagnet is actuated.

15. A switch assembly as claimed by claim 14, wherein said biasing means is a leaf spring exerting on said lever, thus biasing said lever in a direction opposite to the direction effected by said electromagnet.

16. A switch assembly as claimed in claim 9, wherein said first contact means comprises an elongated and stationary first contact member having its intermediate portion supported by said base, and first and second contact points attached to opposite ends of said first contact member.

17. A switch assembly as claimed in claim 2, further comprising a base, wherein said first contact means comprises an elongated and stationary first contact member having its intermediate portion supported by said base, and first and second contact points attached to opposite ends of said first contact member, and wherein said second contact means comprises elongated and movable second and third contact members having their first ends rigidly mounted on said base, and third and fourth contact points attached to said second and third contact members, respectively, at their second ends opposite to said first end in such a manner that said first and second contact points are located in face-to-face relation, respectively, with said third and forth contact points, said second and third contact members being linked with each other to move simultaneously between said break-position in which said first and second contact points are electrically separated from said third and forth contact points, respectively, and said make-position in which said first and second contact points are electrically connected with said third and fourth contact points respectively.

18. A switch assembly as claimed in claim 17, wherein said first magnetic body has a "U" shape configuration having a groove defined therein, said first magnetic body being connected to said first contact member such that said first contact member extends through said groove.

19. A switch assembly as claimed in claim 18, wherein said second magnetic body has a plate configuration, said second magnetic body being connected to said second and third contact members so as to move together with said second and third contact members, said second magnetic body closing said groove to define a closed magnetic loop around said first contact member by said first and second magnetic bodies when said second and third contact members move to said make-position, and opening said groove when said second and third contact members move to said break-position.

20. A switch assembly as claimed in claim 9, wherein said first magnetic body has a "U" shape configuration and is rigidly mounted on said base.

21. A switch assembly as claimed in claim 20, wherein said second magnetic body has a plate configuration and is movably mounted on said base to move between a first position in which the second magnetic body abuts against the first magnetic body to define a closed magnetic loop by said first and second magnetic bodies, and a second position in which said magnetic loop opens.

22. A switch assembly as claimed in claim 21, wherein said first contact means comprises first and second contact members rigidly mounted on said base and extending through a groove defined in said "U" shaped first magnetic body, and first and second contact points mounted on said first and second contact members, respectively, at their ends remote from the base.

23. A switch assembly as claimed in claim 1, further comprising a base, wherein said first magnetic body has a "U" shape configuration and rigidly mounted on said base, wherein said second magnetic body is of a plate configuration movably mounted on said base to move between a first position in which the second magnetic body abuts against the first magnetic body to define a closed magnetic loop by said first and second magnetic bodies and a second position in which said magnetic loop opens, p0 wherein said first contact means comprises first and second contact members rigidly mounted on said base and extending through a groove defined in said "U" shaped first magnetic body, and first and second contact points mounted on said first and second contact members respectively, at their ends remove from the base, and wherein said second contact means comprises an elongated third contact member having its intermediate portion supported by said second magnetic body, and third and fourth contact points attached to opposite ends of said third contact member, said third and fourth contact points being connected to said first and second contact points, respectively, when said second magnetic body moves to said first position, and separated therefrom when said second magnetic body moves to said second position.

24. A switch assembly as claimed in claim 2, further comprising a base, wherein said first contact means comprises an elongated plate shaped first contact member having an intermediate portion provided with an axle which is rotatably supported to said base, and first and second contact points mounted at opposite end portions of said elongated first contact member on opposite faces, respectively.

25. A switch assembly as claimed in claim 24, wherein said second contact means comprises second and third contact members rigidly mounted on said base, and third and fourth contact points mounted on said second and third contact members, respectively, said first contact member being rotated about said axle between said make-position in which said first and second contact points contact with said third and fourth contact points, respectively, and said break-position in which said first and second contact points are separated from said third and fourth contact points, respectively.

26. A switch assembly as claimed in claim 25, wherein said first magnetic body has a "U" shape configuration and is rigidly mounted on said first contact member.

27. A switch assembly as claimed in claim 26, wherein said second magnetic body has a plate configuration and is rigidly mounted on said base, and said first and second magnetic bodies abut against each other to define a closed magnetic loop when said first contact member is rotated to said make-position.

28. A switch assembly as claimed in claim 1, further comprising a casing for locating said first and second contact means in a vacuum.

29. A switch assembly as claimed in claim 1, further comprising a casing for locating said first and second contact means in an atmosphere of inactive gas.

30. A switch assembly as claimed in claim 29, wherein said inactive gas is $SF_6$.

31. A switch assembly as claimed in claim 1, wherein said actuating means is an electromagnet.

32. A switch assembly as claimed in claim 1, wherein said actuating means is a push button.

33. A switch assembly as claimed in claim 1, wherein said actuating means is an electret.

34. A switch assembly as claimed in claim 1, wherein said actuating means is a bimorph.

* * * * *